United States Patent [19]

Hall

[11] 4,399,575

[45] * Aug. 23, 1983

[54] WATERBED MATTRESS WITH UNATTACHED BAFFLE STRUCTURE

[75] Inventor: Charles P. Hall, Muir Beach, Calif.

[73] Assignee: Monterey Manufacturing, Inc., Los Angeles, Calif.

[ * ] Notice: The portion of the term of this patent subsequent to Aug. 24, 1999 has been disclaimed.

[21] Appl. No.: 250,733

[22] Filed: Apr. 3, 1981

Related U.S. Application Data

[63] Continuation-in-part of Ser. No. 201,304, Oct. 27, 1980, and Ser. No. 95,214, Nov. 19, 1979, Pat. No. 4,345,348, which is a continuation-in-part of Ser. No. 949,963, Oct. 10, 1978, Pat. No. 4,247,962, said Ser. No. 201,304, is a continuation-in-part of Ser. No. 95,214.

[51] Int. Cl.[3] ..... A47C 27/08

[52] U.S. Cl. ..... 5/450; 5/451

[58] Field of Search ..... 5/451, 450, 452, 449, 5/422; 220/88 R; 428/314.4, 314.8, 316.6

[56] References Cited

U.S. PATENT DOCUMENTS

| | | | |
|---|---|---|---|
| 1,371,919 | 3/1921 | Mahony | 5/455 |
| 2,604,641 | 7/1952 | Reid | 5/455 |
| 3,585,356 | 6/1971 | Hall | 5/451 |
| 3,600,726 | 8/1971 | Williams | 5/451 |
| 3,732,585 | 5/1973 | Krehbiel | 5/451 |
| 3,736,604 | 6/1973 | Carson | 5/451 |
| 3,748,669 | 7/1973 | Warner | 5/451 |
| 3,772,717 | 11/1973 | Yuen et al. | 5/450 |
| 4,145,780 | 3/1979 | Fogel | 5/451 |
| 4,152,796 | 5/1979 | Fogel | 5/451 |
| 4,168,555 | 9/1979 | Benjamin | 5/452 |
| 4,192,031 | 3/1980 | Fogel | 5/451 |
| 4,245,361 | 1/1981 | Evanson | 5/451 |
| 4,247,962 | 2/1981 | Hall | 5/450 |
| 4,301,560 | 11/1981 | Fraige | 5/450 |
| 4,332,043 | 6/1982 | Larson | 5/451 |
| 4,345,348 | 8/1982 | Hall | 5/451 |

FOREIGN PATENT DOCUMENTS

| | | | |
|---|---|---|---|
| 387528 | 9/1976 | Sweden | 5/450 |
| 608951 | 2/1979 | Switzerland | 5/450 |

*Primary Examiner*—Alexander Grosz
*Attorney, Agent, or Firm*—Lyon & Lyon

[57] ABSTRACT

A waterbed mattress has a baffle structure comprising a horizontally extending buoyant pad. The pad is anchored to an underlying anchor sheet that is not secured to the walls of the mattress. A porous mass of bound together fibers is positioned between the anchor sheet and the pad.

19 Claims, 4 Drawing Figures

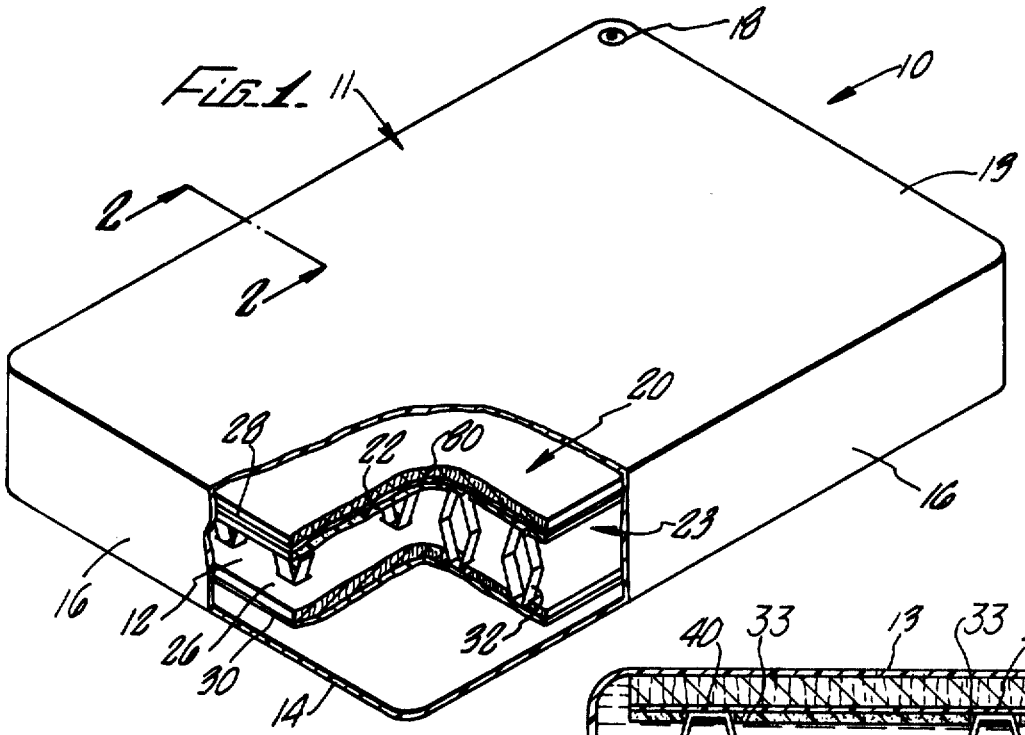
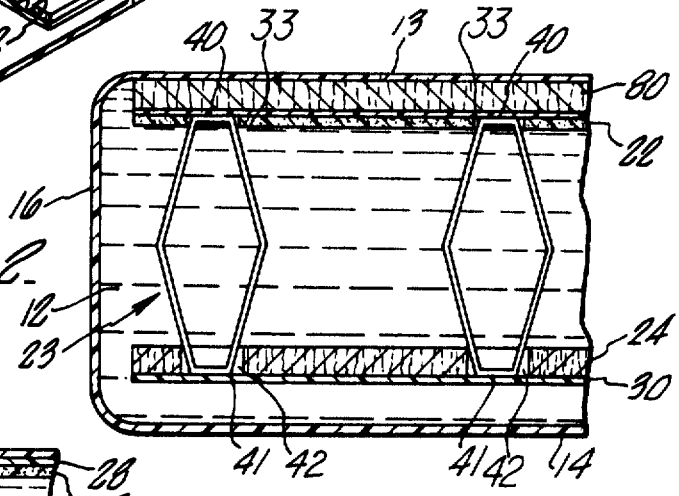
FIG. 2.
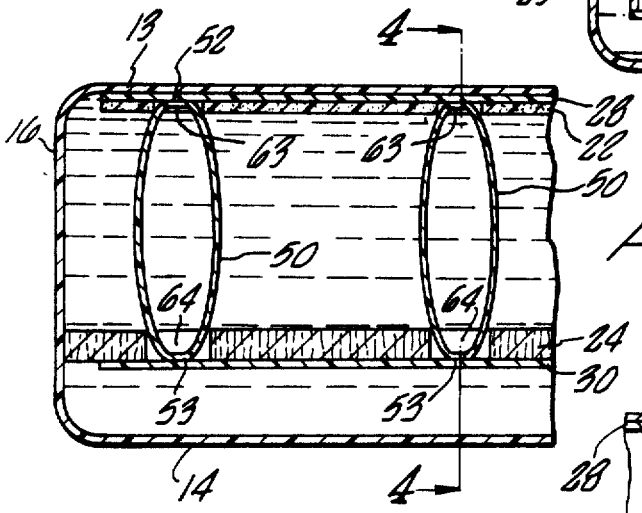
FIG. 3.
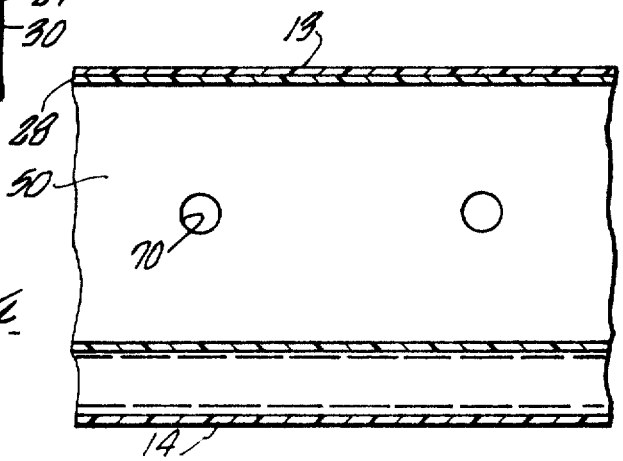
FIG. 4.

WATERBED MATTRESS WITH UNATTACHED BAFFLE STRUCTURE

CROSS-REFERENCE

This application is a continuation-in-part of U.S. Patent Application Ser. No. 95,214 filed on Nov. 19, 1979 now U.S. Pat. No. 4,345,348, which is a continuation-in-part of Application Ser. No. 949,963 filed on Oct. 10, 1978 which is now U.S. Pat. No. 4,247,962. This application is also a continuation-in-part of Application Ser. No. 201,304 filed Oct. 27, 1980, which in turn is a continuation-in-part of the aforesaid Application Ser. No. 95,214 and which is related to Application Ser. No. 134,629 filed on Mar. 27, 1980 now abandoned.

BACKGROUND

This invention pertains generally to waterbeds, and more particularly to a waterbed mattress having a baffle structure for preventing excessive undulations of water in the mattress.

Although waterbeds have enjoyed wide popularity in recent years, some persons are disturbed by the wave-like motion or undulations of the water within the mattress. There have been many attempts to reduce the water movement, for example, by employing vertically-extending baffles inside the mattress. Carson in U.S. Pat. No. 3,736,604 describes a waterbed mattress having perforated, freely-swingable vertical flaps to resist excessive motion of fluid within the mattress. In addition, Fogel in U.S. Pat. No. 4,145,780 describes a waterbed mattress having a baffle dampener comprising an upstanding plastic sheet and a horizontal floatation rod.

Improvements in dampening wave motion have been obtained by using horizontally-extending baffles. Such baffles are described in my aforementioned Application Ser. Nos. 95,214, now U.S. Pat. No. 4,345,348, and 201,304 and my U.S. Pat. No. 4,247,962. These horizontally-extending baffles can comprise a pad of buoyant material anchored to the bottom wall of the mattress so that the pad floats between the top and bottom walls. Fogel in U.S. Pat. No. 4,192,031 describes a baffle comprising a horizontally-extending piece of foam anchored to the bottom of the mattress. Although horizontally extending baffles can be effective in reducing water wave motion, baffles welded to a wall of the mattress such as taught by Fogel can form a leak path at the weld due to stresses on the weld.

My U.S. Pat. No. 3,585,356 shows a waterbed mattress having a plurality of solid particles of a material such as Styrofoam TM (an expanded synthetic resinous material) floating in the water for dampening shock a waves in the water. Although the particles of Styrofoam TM (an expanded synthetic resinous material) can reduce wave motion, if the Styrofoam TM (an expanded synthetic resinous material) is provided as a solid block more effective wave reduction results. However, it is difficult to fold a solid block of Styrofoam TM (an expanded synthetic resinous material) in a mattress for storage or shipping.

In place of Styrofoam TM (an expanded synthetic resinous material), my Application Ser. No. 201,304 describes use of a mass of nonwoven polyester fiber bound together with acrylic resin. This material has been used in waterbed mattresses marketed by Vinyl Products under the tradename Dream Weaver. An advantage of using this material for a baffle is that it can be compacted due to its porosity so that a mattress containing the material can be folded for shipping and storage. However, the material when used by itself in a Dream Weaver mattress has a significant disadvantage; it is more dense than water and thus is in contact with the bottom surface of the mattress, including where the mattress is in contact with a heater. Because the bottom surface adjacent the heater is in contact with the baffle material, hot spots can develop. Such spots can shorten the useful life of the mattress and can lead to water leaks.

Therefore, it is apparent that there is a need for a baffled waterbed mattress that (i) can be folded, (ii) has the advantages of a horizontally-extending baffle, (iii) does not require the baffle to be secured to any of the walls of the mattress, and (iv) has a baffle that floats spaced apart from the bottom wall of the mattress.

SUMMARY

The present invention is directed to a novel waterbed mattress satisfying these requirements. The mattress has a novel baffle structure that prevents excessive undulations of water in the mattress. The mattress comprises an enclosing structure having a horizontally-extending top surface and a horizontally-extending bottom surface. Within the enclosing structure is a baffle structure that is unattached to the enclosing structure so that the baffle can float freely.

The baffle structure comprises a horizontally-extending buoyant pad, means anchoring the pad to float within the enclosing structure, and a porous mass of bound together fibers. The pad has a horizontal extent corresponding generally to the sleeping surface of the mattress. The anchor means comprises a flexible sheet overlying the pad and a horizontally extending anchor sheet denser than water underlying and spaced apart from the pad, the anchor sheet not being secured to the enclosing structure. There are connecting means affixed to the overlying sheet and the anchor sheet. A porous mass of bound together fibers is located between the anchor sheet and the pad.

Preferably, for most effective reduction of wave motion, the pad and/or the anchor sheet is disposed to float horizontally spaced apart from the top wall and the bottom wall.

The materials for the baffle structure are chosen so that the entire waterbed mattress, including the baffle structure, can be folded for storage. For example, the anchor means can be flexible vinyl and the pad can comprise closed cell polymeric foam.

In use, the combination of the horizontally-extending pad, horizontally-extending anchor sheet, and the porous mass of fibers quickly and effectively dampen wave action. With a horizontal surface (the anchor and/or pad) spaced apart from the top and bottom half of the mattress, any waves reflected from top surface or the bottom surface of the mattress are quickly dampened. Because the pad and the fiber are spaced apart from the bottom surface, including where the heater is located, formation of hot spots is avoided.

DRAWINGS

These and other features, aspects, and advantages of the present invention will become better understood with reference to the following description, appended claims, and accompanying drawings where:

FIG. 1 is a perspective view, partly broken away, of a waterbed mattress according to the present invention, having a free-floating baffle;

FIG. 2 is a fragmentary sectional view of the mattress of FIG. 1 taken along line 2—2 in FIG. 1;

FIG. 3 is a fragmentary sectional view of another waterbed mattress according to the present invention taken in a direction corresponding to line 2—2 in FIG. 1; and FIG. 4 is a fragmentary cross-sectional view of the waterbed mattress of FIG. 3 taken on line 4—4 of FIG. 3.

DESCRIPTION

The present invention is directed to a foldable waterbed mattress 10 that has significantly less wave-like motion at the surface of the mattress than conventional waterbed mattresses. This novel waterbed mattresses has an enclosing structure 11 containing a body of water 12. The enclosing structure is fabricated of a flexible material and includes a top wall or surface 13, a bottom wall or surface 14, and side walls 16. The top surface is adapted for receiving persons in sitting and reclining positions and is referred to as the sleeping surface of the mattress. The enclosing structure can be formed in any suitable manner, for example, by bonding two planar sheets together along their peripheries or by bonding upstanding sheets between the edges of the top and bottom walls to form a contoured or fitted structure. Water is introduced into and removed from the mattress through a valve 18 located toward a corner of the top wall.

The enclosing structure can be made of a flexible material such as polyvinylchloride or polyethylene. As described in U.S. Patent Application Ser. Nos. 134,629 now abandoned, and 134,628, filed Mar. 27, 1980, the mattress can comprise an internal enclosing structure made of a material that is unaffected by long-term direct contact with water, such as polyethylene. The internal enclosing structure can be provided with an exterior envelope of a material such as polyvinylchloride. Between the envelope and the internal enclosing structure can be an internal layer of viscous, water-resistant sealing material for sealing leaks in the envelope. A valve suitable for such a waterbed mattress is described in my copending Application Ser. No. 134,627 filed Mar. 27, 1980 now abandoned.

With reference to FIGS. 1 and 2, the waterbed mattress is provided with a baffle or structure 20 within the enclosing structure. The baffle structure 20 is unattached to the enclosing structure, i.e. it can float freely in the mattress when mattress is filled with water, and is not anchored to the side, bottom, or top walls. The baffle structure 20 generally comprises a horizontally-extending buoyant pad 22, anchor means 23, and a layer 24 comprised of a porous mass of bound together fibers. The baffle structure 20 is positioned within the mattress to reduce the wave-like motion of the water. The baffle structure 20 has a horizontal extent corresponding generally to the sleeping surface of the mattress.

The pad 22 is preferably formed of a closed-cell polymeric foam such as polyurethane foam, Styrofoam TM (an expanded synthetic resinous material) or polyethylene foam.

The fibrous layer 24 can be of the same surface area as the pad 20 with coinciding edges. Preferably, as shown in FIG. 3, the fibrous layer has the same surface area as the sleeping surface, i.e., it is coextensive with the top wall 13 of the mattress. This locates the baffle structure relative to the sleeping surface.

A preferred material for the layer 24 is 45 denier nonwoven polyester fibers bound together with acrylic resin, which is available from E. R. Carpenter of La Mirada, Calif. This material is foldable so that the mattress can be stored easily. Because of the porosity of the fiber, the material is sufficiently porous that it is possible to pour water right through it. A particular advantage of the material available from E. R. Carpenter is that it is produced by an air-lay process, where the fibers are both vertically and horizontally oriented before they are bound together with resin. Because the fibers are vertically oriented, the layer 24 is stronger and has more loft per pound of fiber than if the fibers were only horizontally oriented. Because of the extra loft, it is possible to obtain more dampening per pound of fiber compared to a layer made only of horizontally oriented fibers.

If desired, a plurality of individual pads can be used in place of the buoyant pad 22 and/or a plurality of individual pads of fiber can be used in place of the layer 24.

The figures show two different anchor structures. With reference to FIGS. 1 and 2, the anchor structure comprises a flexible sheet 28 overlying the pad 22, a flexible horizontally extending anchor sheet 30 underlying and spaced apart from the pad 22, and a plurality of flexible straps 32. The straps 32 extend through openings 33 in the pad. As illustrated, the straps 32 are formed as loops which are bonded at the top to the overlying sheet 28 at spaced apart points as indicated at 40. Similarly, the straps are bonded at the bottom to the anchor sheet 30 at spaced apart points as indicated at 41.

The straps are arranged in rows which extend lengthwise to the mattress. In a king-sized mattress, for example, there can be six rows of straps, with eight straps in each row. In this embodiment, the straps are spaced about 10 inches apart in either lateral direction, but other strap arrangements and spacings can be utilized, if desired. There are holes 42 cut in the layer 24 of fiber through which the straps pass.

The straps, overlying sheet, and anchor sheet are fabricated of a flexible material such as 8 to 20 mil vinyl. The bonds between the straps and overlying sheet and the anchor sheet are formed by suitable means such as RF welding. The straps can be of any suitable width. In the embodiment of FIGS. 1–2, they are in the order of 3 inches wide.

The version of the invention shown in FIGS. 3 and 4 has a baffle structure similar to that of FIGS. 1–2 except that elongated tubular members 50 are used in place of the individual straps. The tubular members are fabricated of a flexible material such as vinyl and are affixed at spaced apart points 52, 53, to the overlying sheet 28 and anchor sheet 30, respectively. Each tubular member corresponds to one row of straps, and a king-size mattress can, for example, have eight tubular members positioned side-by-side and extending lengthwise within the mattress. The tubular members are bonded to the overlying sheet 28 through openings 63 in the buoyant pad 22. The tubular members are bonded to the anchor sheet 30 through openings 64 in the fiber layer 24. The ends of the tubular members 50 are open, and vent holes 70 can be formed in the side walls of the members for water circulation. The vent holes 70 can be in the order of 3 inches in diameter and spaced apart about 10 inches along the tubes. The tubes can be about 4–5 inches in diameter, having a vertical extent of about 6 inches within the mattress. There can be about eight equally spaced apart tubes.

For effective reduction of the wave motion, preferably the baffle structure 20 has a horizontal extent corresponding generally to the horizontal extent of the top surface 13 of the mattress. In a king-sized mattress having a sleeping area measuring 84×72 inches, the baffle structure can have a length of 76 inches and a width of 64 inches. It is important that the baffle structure has a large horizontal extent to obtain adequate dampening of the wave-like motion of the water in the waterbed. To obtain adequate dampening, preferably the pad and the anchor sheet have a horizontal extent such that their top surface area is equal to at least about two-thirds of the surface area of the sleeping surface, and more preferably is equal to at least about three-quarters of the surface area of the sleeping surface, and most preferably is coextensive with the sleeping surface to positively locate the baffle structure.

If desired, more than one baffle structure 20 can be used, so that the total surface area of the baffles is equal to at least about two-thirds of the surface area of the sleeping surface. Preferably only one baffle structure is used for ease of fabrication and folding.

Preferably the pad 22 is spaced apart from the top wall 13 and/or the anchor sheet 30 is spaced apart from the bottom wall 14. This provides effective wave dampening action in that waves reflected off the top and bottom walls of the mattress are dampened. To achieve this result, it is necessary that the total vertical extent of the baffle structure 20 be less than the total vertical extent or height, H, of the mattress 10 when filled with water.

The exact free-floating position of the baffle structure 20 depends upon the relative size and relative densities of the materials used. However, as long as the total height of the baffle structure 20 is smaller than the height of the mattress, there is at least one baffle surface having a horizontal extent corresponding generally to the sleeping surface of the mattress where the baffle surface permits water to circulate between the volume below and the volume above it.

In both versions of FIGS. 1–4, the anchor sheet 30 is spaced apart from the bottom wall 14 because of the buoyancy of the foam pad 22. In the version of FIGS. 1 and 2, the pad 22 is maintained spaced apart from the top wall 13 by means of a layer or sheet 80 of a porous, compressible mass of bound-together fibers of the same material as used for the fibrous layer 24. Thus, in the version of FIGS. 1 and 2, there are two horizontally-extending baffle structures, each having a horizontal extent corresponding generally to the sleeping surface of the mattress, and each permitting water to circulate between the volume below and the volume above it. Because of the porosity of the fibrous mass of layer 80, water can circulate from above the pad 22 to below it.

Layer 80, top sheet 28, and pad 22 can be secured together by sewing the layers together.

In a preferred version of the present invention, as shown in FIGS. 3 and 4, the overlying sheet 28 and anchor sheet 30 are formed of 8 mil polyvinylchloride. The buoyant pad 22 is formed of one-quarter inch thick polyethylene closed-cell foam. There are eight tubular members, each having a vertical extent of about six inches when the mattress is filled with water. The fibrous layer 24 is about one and one-half inches thick and is positioned on top of the anchor sheet 30. In addition, fibrous material can be placed within the tubes 50.

The baffle structure 20 and the waterbed mattress 10 having the baffle structure 20 having substantial advantages compared to prior art structures. For example, the baffle structure 20 is free-floating and is not secured to the enclosing structure. This eliminates the welds required for anchorings which can be the source of water leaks. In addition, stress caused on the waterbed mattress resulting from anchoring is eliminated.

A further advantage of the baffle structure 20 is that it can be used with mattresses which are incapable of having baffles requiring anchoring to the enclosing structure.

Although the present invention has been described in considerable detail with reference to certain preferred versions thereof, other versions are possible. For example, the baffle structure 20 need not be provided or sold as an integral part of an existing mattress. Therefore the spirit and scope of the appended claims should not necessarily be limited to the description of the preferred version contained herein.

What is claimed is:

1. In a waterbed mattress having an enclosing structure comprising a horizontally extending top wall and a horizontally extending bottom wall, the improvement comprising a free-floating baffle structure comprising.

(a) a horizontally extending buoyant pad disposed within the enclosing structure for limiting the motion of water in the mattress, the pad having a horizontal extent corresponding generally to the sleeping surface of the mattress;

(b) means anchoring the pad comprising:

(i) a flexible sheet overlying the pad;

(ii) an anchor sheet denser than water underlying and spaced apart from the pad, the anchor sheet not being secured to the enclosing structure and having a horizontal extent corresponding generally to the sleeping surface of the mattress; and (iii) connecting means affixed to the overlying sheet and the anchor sheet and passing through the pad; and (c) a porous mass of bound together fibers between the anchor sheet and the pad.

2. The mattress of claim 1 wherein the pad is disposed to float spaced apart from the top wall and the bottom wall so that the pad permits water to circulate between the volume below and the volume above the pad.

3. The mattress of claim 2 including a porous mass of bound together fibers between the overlying sheet and the top wall.

4. The mattress of claim 3 in which the porous mass contacts the top sheet.

5. The mattress of claim 1 or 2 wherein the anchor sheet is disposed to float spaced apart from the top wall and the bottom wall so that the anchor sheet permits water to circulate between the volume below and the volume above the anchor sheet.

6. The mattress of claim 1 or 2 wherein the pad has a horizontal extent such that its surface area is at least about ⅔ of the surface area of the sleeping surface.

7. The mattress of claim 1 wherein the anchor sheet has a horizontal extent such that its surface area is at least about ⅔ of the surface area of the sleeping surface.

8. The mattress of claim 1 in which the connecting means comprises a plurality of vertically oriented flexible straps extending through the pad.

9. The mattress of claim 1 in which the connecting means comprises at least one elongated tubular member affixed to the anchor sheet and secured to the overlying sheet at a plurality of spaced apart points through openings in the pad.

10. The mattress of claim 1 in which the pad is fabricated of a closed-cell polymeric foam.

11. The mattress of claim 1 or 2 wherein the pad has a horizontal extent such that its surface area is at least about $\frac{3}{4}$ of the surface area of the sleeping surface.

12. The mattress of claim 1 wherein the anchor sheet has a horizontal extent such that its surface area is at least about $\frac{3}{4}$ of the surface area of the sleeping surface.

13. In a waterbed mattress having an enclosing structure comprising a horizontally extending top wall, a horizontally extending bottom wall, and side walls, the improvement comprising a free-floating baffle structure comprising:

(a) a horizontally extending buoyant pad disposed within the enclosing structure for limiting the motion of water in the mattress, the pad having a horizontal extent corresponding generally to the sleeping surface of the mattress such that its surface area is at least about $\frac{2}{3}$ of the surface area of the sleeping surface;

(b) means anchoring the pad comprising:

(i) a flexible sheet overlying the pad;

(ii) a horizontally-oriented anchor sheet denser than water underlying and spaced apart from the pad, the anchor sheet not being secured to the enclosing structure and floating horizontally spaced apart from the top wall and the bottom wall so as to permit water to circulate between the volume below and the volume above the pad, the anchor sheet having a horizontal extent corresponding generally to the sleeping surface of the mattress such that its surface areas is at least $\frac{2}{3}$ of the surface area of the sleeping surface; and (iii) a plurality of elongated tubular members extending horizontally in the enclosing structure, each tubular member being secured to the anchor sheet and secured to the overlying sheet at a plurality of spaced apart points through openings in the pad; and (c) a porous mass of bound together fibers between the anchor sheet and the pad.

14. The matters of claim 13 wherein the porous mass of bound together fibers has a horizontal extent substantially equal to the horizontal extent of the sleeping surface.

15. The mattress of claim 13 or 14 in which the pad has a horizontal extent substantially equal to the horizontal extent of the sleeping surface.

16. A baffle structure for a waterbed mattress comprising:

(a) a buoyant pad having a horizontal extent corresponding generally to the sleeping surface of the mattress such that its surface area is at least about $\frac{2}{3}$ of the surface area of the sleeping surface;

(b) anchor means for the pad comprising:

(i) a flexible sheet overlying the pad;

(ii) an anchor sheet denser than water underlying and spaced apart from the pad, the anchor sheet not being secured to the enclosing structure, the anchor sheet having a horizontal extent corresponding generally to the sleeping surface of the mattress such that its surface area is at least about $\frac{2}{3}$ of the surface area of the sleeping surface area; and (iii) a plurality of elongated tubular members extending horizontally in the enclosing structure, each tubular member being secured to the anchor sheet and secured to the overlying sheet at a plurality of spaced apart points through openings in the pad; and (c) a porous mass of bound-together fibers between the anchor sheet and the pad.

17. In a waterbed mattress having an enclosing structure comprising a horizontally extending top wall and a horizontally extending bottom wall, the improvement comprising a free-floating baffle structure comprising:

(a) a horizontally extending buoyant pad disposed within the enclosing structure for limiting the motion of water in the mattress, the pad having a horizontal extent corresponding generally to the sleeping surface of the mattress; and (b) means anchoring the pad comprising:

(i) a flexible sheet overlying the pad;

(ii) an anchor sheet denser than water underlying and spaced apart from the pad, the anchor sheet not being secured to the enclosing structure and having a horizontal extent corresponding generally to the sleeping surface of the mattress; and (iii) connecting means affixed to the underlying sheet and the anchor sheet and passing through the pad.

18. The mattress of claim 17 wherein the pad is disposed to float spaced apart from the top wall and the bottom wall so that the pad permits water to circulate between the volume below and the volume above the pad.

19. The mattress of claim 18 including a porous mass of bound together fibers between the overlying sheet and the top wall.

* * * * *